United States Patent [19]

Foley

[11] 4,095,786

[45] Jun. 20, 1978

[54] POOL TABLE POCKET INSERT

[76] Inventor: Leo D. Foley, R.D. No. 3, Titusville, Pa. 16354

[21] Appl. No.: 738,024

[22] Filed: Nov. 2, 1976

[51] Int. Cl.[2] ..... A63D 15/00

[52] U.S. Cl. ..... 273/4 A

[58] Field of Search ..... 273/4 R, 4 A, 13, 14, 273/8, 9, 12

[56] References Cited

U.S. PATENT DOCUMENTS

| | | | |
|---|---|---|---|
| 235,861 | 12/1880 | Estephe | 273/4 A |
| 328,092 | 10/1885 | Waggoner | 273/4 A |
| 640,423 | 1/1900 | Slemmer | 272/9 |
| 694,463 | 3/1902 | Downey | 273/9 |
| 767,309 | 8/1904 | McGee | 273/4 A |
| 1,213,950 | 1/1917 | Ringsmith | 273/9 |

*Primary Examiner*—Richard C. Pinkham
*Assistant Examiner*—T. Brown
*Attorney, Agent, or Firm*—Robert D. Farkas

[57] ABSTRACT

A pool table pocket insert for converting a pool table having lateral cushions bounding the perimeter of the playing surface thereof and a plurality of pockets located therein to a billiard table, the insert including a hollow inflatable bladder which provides a surface adjacent to the pool table cushion, the surface having the same size, shape, and inherent elasticity as the pool table cushion, and means for inflating the bladder.

6 Claims, 4 Drawing Figures

POOL TABLE POCKET INSERT

BACKGROUND OF THE INVENTION

1. Field of the Invention

The present invention relates to pool table accessories, and more particularly, to a pool table insert for converting a pool table to a billiard table.

2. Description of the Prior Art

Several devices have been proposed in the prior art to be inserted into the pockets of a pool table to effect a conversion to a billiard table. Characteristically, these devices are difficult to install in different types of pool tables. Also, they cannot be adjusted in regard to elasticity causing a mismatching of playing action with the permanently installed cushions around the perimeter of the playing surface.

U.S. Pat. No. 767,309 issued to G. McGee on Aug. 9, 1904 discloses a pocket plug for pool tables which includes a pair of angular members joined together by a welt and a spring assembly.

U.S. Pat. No. 980,142 issued to J. Byner on Dec. 27, 1910 teaches a combination pool and billiard table having a plurality of cushion blocks which are inserted into the pool pockets and are retained by notches provided adjacent thereto.

U.S. Pat. No. 1,894,989 issued to P. Hansen on Jan. 24, 1933 reveals a plug for pool table pockets including a cushion member and a threaded rod assembly which engages an internally threaded ferrule installed in the wall of the pocket.

The present invention overcomes the problems associated with the prior art by providing a pool table pocket insert which may be installed in a variety of pool tables without modification thereto and which may be adjusted in elasticity to match the elasticity of the cushions provided by the pool table.

SUMMARY OF THE INVENTION

Therefore, a primary object of the present invention is to provide a pool table pocket insert which may be used to convert a pool table to a billiard table.

A further object of the present invention is to provide a pool table pocket insert which may be installed in a pool table with no modifications thereto.

A still further object is to provide a pool table pocket insert which may be adjusted relative to elasticity to match the elasticity of the cushions provided by the pool table.

Another object is to provide a pool table pocket insert which may be easily and quickly installed and removed.

Still another object is to provide a pool table pocket insert which is simple in design, inexpensive to manufacture and durable.

These objects, as well as further objects and advantages, of the present invention will become readily apparent after reading the description of a non-limiting illustrative embodiment and the accompanying drawing.

According to the principles of the present invention, a pool table pocket insert for converting a pool table having lateral cushions bounding the perimeter of the playing surface thereof and a plurality of pockets located therein to a billiard table includes a hollow inflatable bladder dimensioned for insertion into one of the pool table pockets, the bladder providing a surface having inherent elasticity, size and shape substantially the same as the lateral cushions, the surface disposed within the openings in the lateral cushions adjacent the pockets when said bladder is inserted therein, the surface acting substantially as the lateral cushions, and means for inflating the bladder.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
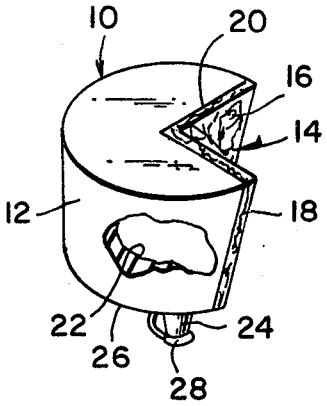
FIG. 1 is a perspective view of the preferred embodiment configured for insertion in a corner pocket.

Referring now to the figures, and more particularly to FIG. 1, there is illustrated therein a pool table pocket insert 10 for insertion into a corner pocket of a pool table. The insert 10 includes an inflatable bladder 12 which is shaped for snug insertion into a corner pocket. The insert 10 provides a surface 14 which is substantially the same size and shape as the lateral cushions which customarily bound the perimeter of the playing surface of a pool table. The surface 14 includes two sections 16 and 18 which are disposed at right angles to each other and are disposed in planes which are transverse to the playing surface of the pool table when inserted in the corner pocket thereof. The sections 16 and 18 have a shape which will conform to the shape of an adjacent lateral cushion of the pool table and will provide a continuous surface which cushions a propelled pool ball uniformly. The two sections 16 and 18 are preferably covered with felt 20 or the like. The insert 10 forms a chamber 22 therein which is inflated by an air valve 24 that is operably secured to a wall 26 of the bladder 12. An air valve cover 28 is provided to seal the valve 26 in a conventional manner. The bladder 12 is preferably constructed of a semi-resilient material such as rubber or the like and may be inflated to various pressures which correspond to the inherent elasticity of the lateral cushions provided by the pool table.

Figure 2:
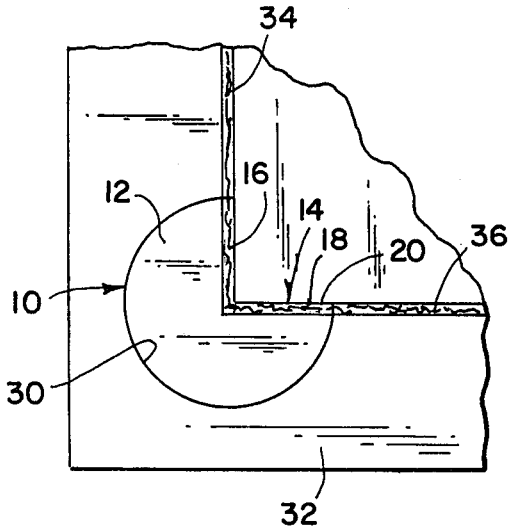
FIG. 2 is a top view of the preferred embodiment installed in a corner pocket.

FIG. 2 illustrates the insert 10 positioned for use within the corner pocket 30 of a pool table 32. The sections 16 and 18 are shown aligned with the lateral cushions 34 and 36 provided by the pool table 32.

Figure 3:
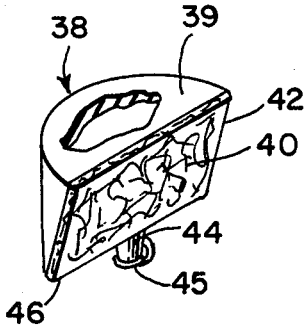
FIG. 3 is a perspective view of an alternate preferred embodiment configured for insertion into a side pocket.

FIG. 3 illustrates a pool table pocket insert 38 configured for insertion into a side pocket. The insert 38 includes a bladder 39 which provides a surface 40 that is substantially the same size and shape as the lateral cushions of the pool table customarily provided adjacent to the side pockets thereof. The surface 40 falls in a plane which is substantially transverse to the playing surface of the pool table when the insert 38 is inserted into a corner pocket, and conforms in shape to the adjacent lateral cushions. The surface 40 is preferably covered with felt 42 or the like. The bladder 39 is inflated to a pressure which corresponds to the desired resiliency of the surface 40 by an air valve 44 and cover 45 operably secured to the side 46 of the insert 38.

Figure 4:
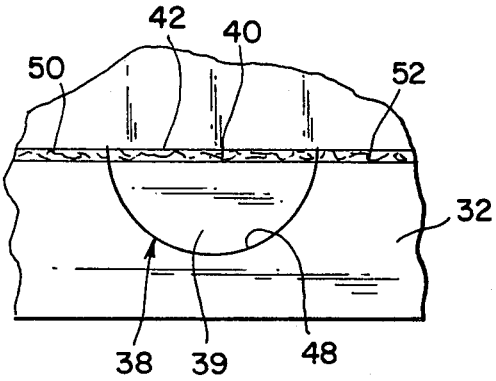
FIG. 4 is a top view of the alternate preferred embodiment installed in a side pocket.

FIG. 4 illustrates the insert 38 positioned for use within a side pocket 48 of the pool table 32. The surface 40 is shown aligned with the lateral cushions 50 and 52 provided by the pool table 32 thereby providing a uniform surface for the impact of a pool ball.

The inserts 10 and 38 can be employed to convert a conventional pool table to a billiard table with little work and no modification to the table. An insert 10 would be inserted into each of the four corner pockets, and an insert 38 into each of the side pockets. When the user desires to convert the table back to a pool table, the inserts 10 and 38 are simply removed and deflated for storage.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. The combination of a pool table and a pool table pocket insert, said pool table comprising a lateral playing surface, said playing surface bounded by four elongated cushions upstanding from said playing surface, a pair of 1st pockets disposed in a pair of opposed cushions, four 2nd pockets disposed in and between adjacent cushions, said 1st and 2nd pockets extending outwardly from said playing surface and downwardly from the uppermost regions of said four cushions and said playing surface, each of said four cushions having a surface thereof disposed adjacent said playing surface, said surface of said cushions being resilient, said pocket insert comprising a hollow inflatable bladder dimensioned for insertion selectively into one of said first and said second pool table pockets, said bladder providing a ball contacting surface having inherent elasticity substantially the same as said surface of said lateral cushions, said ball contacting surface of said bladder being disposed adjacent to said surface of said lateral cushions when said bladder is selectively inserted in said 1st and 2nd pockets, said ball contacting surface of said bladder causing a contacting ball to react equivalent to said lateral cushions, means for inflating and deflating said bladder, said inflating means including valve means fixedly secured to the outermost surface of said bladder, said valve being means for communicating air into said bladder and for retaining said air therein, said valve means disposed on a lowermost surface of said bladder when said bladder has the uppermost surface thereof disposed adjacent said uppermost regions of said cushions.

2. A pool table pocket insert as claimed in claim 1, wherein said valve means comprises an air valve, and an air valve cover dimensioned to cooperate therewith.

3. A pool table pocket insert as claimed in claim 1, wherein said ball contacting surface of said bladder further comprises felt fixedly secured thereto.

4. A pool table pocket insert as claimed in claim 1, wherein said ball contacting surface of said bladder for insertion into one of said pair of 1st pockets resides in a plane substantially upstanding from said playing surface and conforming to said surface of said opposed cushions adjacent thereto.

5. A pool table pocket insert as claimed in claim 1, wherein said ball contacting surface of said bladder for insertion into one of said 2nd pockets provides two halves disposed at right angles in relation to each other, said halves each disposed in a different plane, said planes being substantially transverse to said playing surface and conforming to said surface of each of said lateral cushions adjacent thereto.

6. A pool table pocket insert as claimed in claim 1, wherein said bladder is constructed of a semi-resilient material.

* * * * *